US007176854B2

(12) United States Patent
Lee et al.

(10) Patent No.: US 7,176,854 B2
(45) Date of Patent: Feb. 13, 2007

(54) DEVICE AND METHOD FOR DRIVING PLASMA DISPLAY PANEL

(75) Inventors: Jun-Young Lee, Cheonan (KR); Jin-Sung Kim, Cheonan (KR); Chan-Young Han, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 531 days.

(21) Appl. No.: 10/762,041

(22) Filed: Jan. 21, 2004

(65) Prior Publication Data

US 2004/0150587 A1 Aug. 5, 2004

(30) Foreign Application Priority Data

Jan. 29, 2003 (KR) ..... 10-2003-0005993

(51) Int. Cl.
*G09G 3/28* (2006.01)

(52) U.S. Cl. ..... 345/60; 315/169.4

(58) Field of Classification Search ..... 345/60–72; 315/169.1–164

See application file for complete search history.

(56) References Cited

U.S. PATENT DOCUMENTS 5,786,794 A * 7/1998 Kishi et al. ..... 345/60
6,281,635 B1 * 8/2001 Lee ..... 315/169.4
6,657,604 B2 * 12/2003 Huang et al. ..... 345/60
6,680,581 B2 * 1/2004 Lee et al. ..... 315/169.3
6,768,270 B2 * 7/2004 Chae ..... 315/169.3
6,933,679 B2 * 8/2005 Lee et al. ..... 315/169.4
6,961,031 B2 * 11/2005 Lee et al. ..... 345/60
7,009,588 B2 * 3/2006 Lee et al. ..... 345/68

(Continued)

FOREIGN PATENT DOCUMENTS

EP 1 065 650 A2 1/2001

(Continued)

OTHER PUBLICATIONS

Patent Abstracts of Japan for Publication No. 08-320667; Date of publication of application Dec. 3, 1996, in the name of Kanazawa Giichi.

Patent Abstracts of Japan for Publication No. 11-015426; Date of publication of application Jan. 22, 1999, in the name of Yoshino Akio.

(Continued)

*Primary Examiner*—Sumati Lefkowitz
*Assistant Examiner*—Rodney Amadiz
(74) *Attorney, Agent, or Firm*—Christie, Parker & Hale, LLP

(57) ABSTRACT

Disclosed is a PDP driving circuit and a driving method thereof. A first switch is coupled between a Y electrode of a panel capacitor and a positive polarity terminal of a voltage source supplying a voltage Vs/2, a second switch is coupled between the positive polarity terminal of the voltage source and ground, a third switch is coupled between the Y electrode and a negative polarity of the voltage source, and a fourth switch is coupled between the negative polarity of the voltage source and ground. The voltage −Vs/2 is applied to an X electrode of the panel capacitor while the voltage Vs/2 is applied to the Y electrode thereof, and the voltage Vs/2 is applied to the X electrode while the voltage −Vs/2 is applied to the Y electrode.

20 Claims, 9 Drawing Sheets

U.S. PATENT DOCUMENTS

| | | | | |
|---|---|---|---|---|
| 7,023,139 | B2 * | 4/2006 | Lee et al. | 315/169.1 |
| 7,027,010 | B2 * | 4/2006 | Lee | 345/60 |
| 2003/0193454 | A1 * | 10/2003 | Lee et al. | 345/63 |
| 2004/0008163 | A1 * | 1/2004 | Lee | 345/60 |
| 2004/0135746 | A1 * | 7/2004 | Lee et al. | 345/60 |

FOREIGN PATENT DOCUMENTS

| | | |
|---|---|---|
| JP | 08-320667 | 12/1996 |
| JP | 9-54565 | 2/1997 |
| JP | 11-015426 | 1/1999 |
| JP | 2002-62844 | 2/2002 |

OTHER PUBLICATIONS

Patent Abstracts of Japan for Publication No. 09-054565, date of publication of Feb. 25, 1997, in the name of H. Kinoshita et al.

Patent Abstract of Japan, Publication No. 2002-062844, Published on Feb. 28, 2002, in the name of Kishi, et al.

* cited by examiner

DEVICE AND METHOD FOR DRIVING PLASMA DISPLAY PANEL

CROSS REFERENCE TO RELATED APPLICATION

This application claims priority to and the benefit of Korean Patent Application No. 2003-5993 filed on Jan. 29, 2003 in the Korean Intellectual Property Office, the entire content of which is incorporated herein by reference.

BACKGROUND OF THE INVENTION (a) Field of the Invention

The present invention relates to a device and method for driving a plasma display panel (PDP).

(b) Description of the Related Art

The PDP is a flat panel display that uses plasma generated by gas discharge to display characters or images. Depending on its size, a PDP can include anywhere from several scores to millions of pixels arranged in a matrix pattern. A PDP is classified as a direct current (DC) type or an alternating current (AC) type based on its discharge cell structure and the waveform of the driving voltage applied thereto.

The waveform for driving an AC type PDP includes a reset period, an addressing period, a sustain period, and an erase period, in temporal sequence.

The reset period is for initiating the status of each cell so as to facilitate the addressing operation. The addressing period is for selecting turn-on/off cells and applying an address voltage to the turn-on cells (i.e., addressed cells) to accumulate wall charges. The sustain period is for applying sustain pulses and causing a discharge for displaying an image on the addressed cells. The erase period is for reducing the wall charges of the cells to terminate the sustain.

In the AC type PDP, the scan and sustain electrodes for sustaining act as a capacitance load, so capacitance exists between the scan and sustain electrodes. Such capacitance may be referred to as panel capacitance and equivalently represented by a panel capacitor. A driver circuit for applying sustain pulses to the panel capacitor, for example, is suggested by Kishi et al. (Japanese Patent No. 3201603).

The driver circuit suggested by Kishi et al. alternately applies voltages Vs/2 and −Vs/2 to the Y electrode of the panel capacitor by using a capacitor and a voltage source for supplying a voltage Vs/2 that is one half of the voltage Vs necessary for sustaining. More specifically, the driver circuit applies a voltage of Vs/2 to the Y electrode of the panel capacitor through the voltage source, and charges a voltage Vs/2 in the capacitor. Then, the capacitor is coupled between the ground terminal and the Y electrode of the panel capacitor to apply a voltage −Vs/2 to the Y electrode of the panel capacitor.

In this manner, the positive voltage +Vs/2 and the negative voltage −Vs/2 can be alternately applied to the Y electrode. Likewise, the positive voltage +Vs/2 and the negative voltage −Vs/2 can be alternately applied to the X electrode. The respective voltages ±Vs/2 applied to the X and Y electrodes are phase-inverted to each other, so the voltage Vs/2 necessary for sustaining is applied to both terminals of the panel capacitor.

This driver circuit can be used only for the PDP using the pulse swinging between −Vs/2 and Vs/2, and the withstand voltage of transistors cannot be sustained at Vs/2 because of the characteristics of the transistors. Moreover, this driver circuit requires a capacitor having high capacity to store a voltage used for the negative voltage and causes a considerable amount of in-rush current during starting due to the capacitor.

SUMMARY OF THE INVENTION

In one exemplary embodiment of the present invention, a PDP driver circuit uses switches having a low withstand voltage.

In another exemplary embodiment of the present invention, a capacitor having large capacitance is removed and an in-rush current is reduced.

In the exemplary embodiments, a floating voltage source is coupled between nodes of switches coupled in series.

In an exemplary embodiment of the present invention, a PDP driver for applying a driving voltage to a panel capacitor formed between first and second electrodes and having first and second ends, is provided. The PDP driver includes: a first voltage source having a positive polarity terminal and a negative polarity terminal for supplying a first voltage; a second voltage source for supplying a second voltage; a first switch coupled between a first end of the panel capacitor and the positive polarity terminal of the first voltage source; a second switch coupled between the positive polarity terminal of the first voltage source and the second voltage source; a third switch coupled between the first end of the panel capacitor and a negative polarity terminal of the first voltage source; and a fourth switch coupled between the negative polarity terminal of the first voltage source and the second voltage source.

When the first and fourth switches are turned on, a third voltage is applied to the first end of the panel capacitor, the third voltage being a voltage difference between the first and second voltages. When the second and third switches are turned on, a fourth voltage is applied to the first end of the panel capacitor, the fourth voltage being a voltage difference between a negative value of the first voltage and the second voltage. The first and fourth switches and the second and third switches are alternately turned on to alternately apply the third and fourth voltages, respectively, to the first end of the panel capacitor.

A voltage difference between the third and fourth voltages is a sustain voltage for a PDP. The fourth voltage is applied to the second end of the panel capacitor while the third voltage is applied to the first end of the panel capacitor, and the third voltage is applied to the second end of the panel capacitor while the fourth voltage is applied to the first end of the panel capacitor.

In another exemplary embodiment of the present invention, a PDP driver for applying a driving voltage to a panel capacitor formed between first and second electrodes and having first and second ends, is provided. The PDP driver includes: a first voltage source having a positive polarity terminal and a negative polarity terminal for supplying a first voltage; a second voltage source for supplying a second voltage; a first switch coupled between the first end of the panel capacitor and the positive polarity terminal of the first voltage source; and a second switch coupled between the first end of the panel capacitor and the negative polarity terminal of the first voltage source.

A first electrical path is formed between the negative polarity terminal of the first voltage source and the second voltage source so as to apply a third voltage to the first end of the panel capacitor when the first switch is turned on, the third voltage being a difference between the first and second voltages. A second electrical path is formed between the positive polarity terminal of the first voltage source and the second voltage source so as to apply a fourth voltage to the first end the panel capacitor when the second switch is turned on, the fourth voltage being a difference between a negative value of the first voltage and the second voltage. The first and second switches are alternately turned on.

The fourth voltage is applied to the second end of the panel capacitor while the third voltage is applied to the first end of the panel capacitor, and the third voltage is applied to the second end of the panel capacitor while the fourth voltage is applied to the first end of the panel capacitor. A voltage difference between the third and fourth voltages is a sustain voltage for a PDP. The first voltage is one half of the sustain voltage, and the second voltage is a ground voltage.

The PDP driver includes a power recovery section coupled to the first end of the panel capacitor, the power recovery section including an inductor, and being adapted for using resonance generated between the inductor and the panel capacitor to change the voltage at the first end of the panel capacitor.

The power recovery section uses a voltage difference between the first and second voltage sources to inject current to the inductor, and generates the resonance while the current flows to the inductor.

In yet another exemplary embodiment of the present invention, a method for driving a PDP by alternately applying first and second voltages to a panel capacitor formed between first and second electrodes is provided. The method includes: coupling a positive polarity terminal of a floating voltage source for supplying a third voltage to a first end of the panel capacitor; coupling a negative polarity terminal of the floating voltage source to a first voltage source for supplying a fourth voltage; coupling the negative polarity terminal of the floating voltage source to the first end of the panel capacitor; and coupling the positive polarity terminal of the floating voltage source to the first voltage source. A voltage difference between the third and fourth voltages corresponds to the first voltage, and a voltage difference between a negative value of the third voltage and the fourth voltage corresponds to the second voltage.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain exemplary embodiments of the present invention are shown and described, simply by way of illustration. As will be realized, the described exemplary embodiments can be modified in various different ways, all without departing from the spirit or scope of the present invention. Accordingly, the drawings and description are to be regarded as illustrative in nature, and not restrictive.

Hereinafter, an apparatus and method for driving a PDP according to exemplary embodiments of the present invention will be described in detail with reference to the accompanying drawings.

First, a PDP according to an exemplary embodiment of the present invention will be described with reference to FIG. 1.

Figure 1:
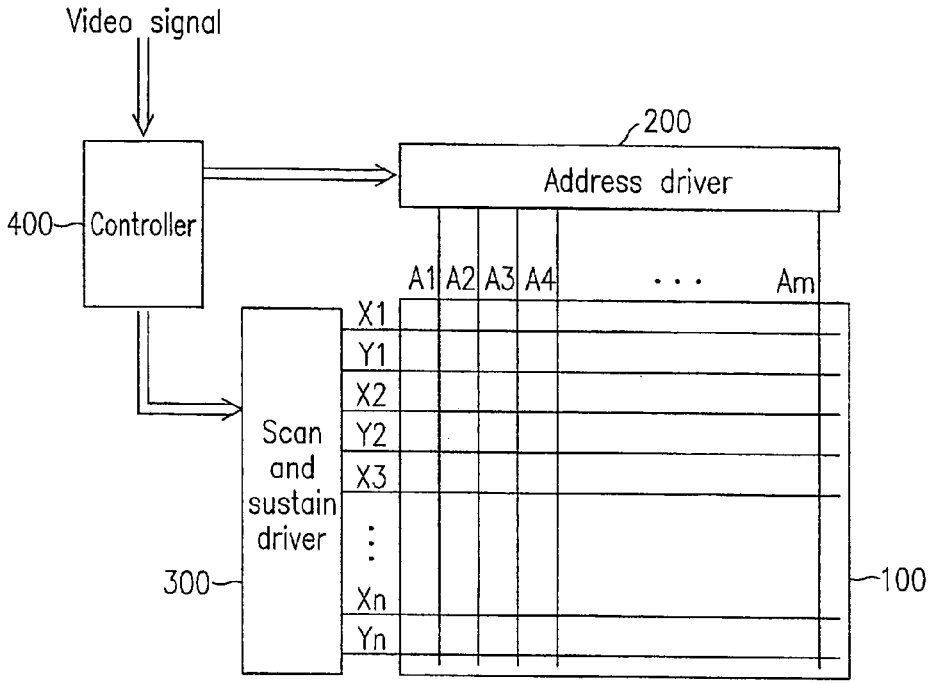
FIG. 1 shows a schematic plan diagram of a PDP according to an exemplary embodiment of the present invention.

FIG. 1 shows a schematic block diagram of the PDP according to an exemplary embodiment of the present invention.

The PDP of FIG. 1 includes a plasma panel 100, an address driver 200, a scan/sustain driver 300, and a controller 400.

The plasma panel 100 includes a plurality of address electrodes A1 to Am arranged in columns, and a plurality of scan electrodes (referred to as Y electrodes hereinafter) Y1 to Yn and sustain electrodes (referred to as X electrodes hereinafter) X1 to Xn alternately arranged in rows. The address driver 200 receives an address drive control signal from the controller 400, and applies to the individual address electrodes A1 to Am a display data signal for selection of a discharge cell to be displayed. The scan/sustain driver 300 receives a control signal from the controller 400, and applies voltage for sustaining alternately to the Y electrodes Y1 to Yn and the X electrodes X1 to Xn, causing the selected discharge cells to be sustained. The controller 400 externally receives an image signal (i.e., a video signal), generates the address drive control signal and the sustain signal, and applies them to the address driver 200 and the scan/sustain driver 300, respectively.

Hereinafter, the driver circuit of the scan/sustain driver 300 according to a first exemplary embodiment of the present invention will be described in detail with references to FIGS. 2 to 4B.

Figure 2:
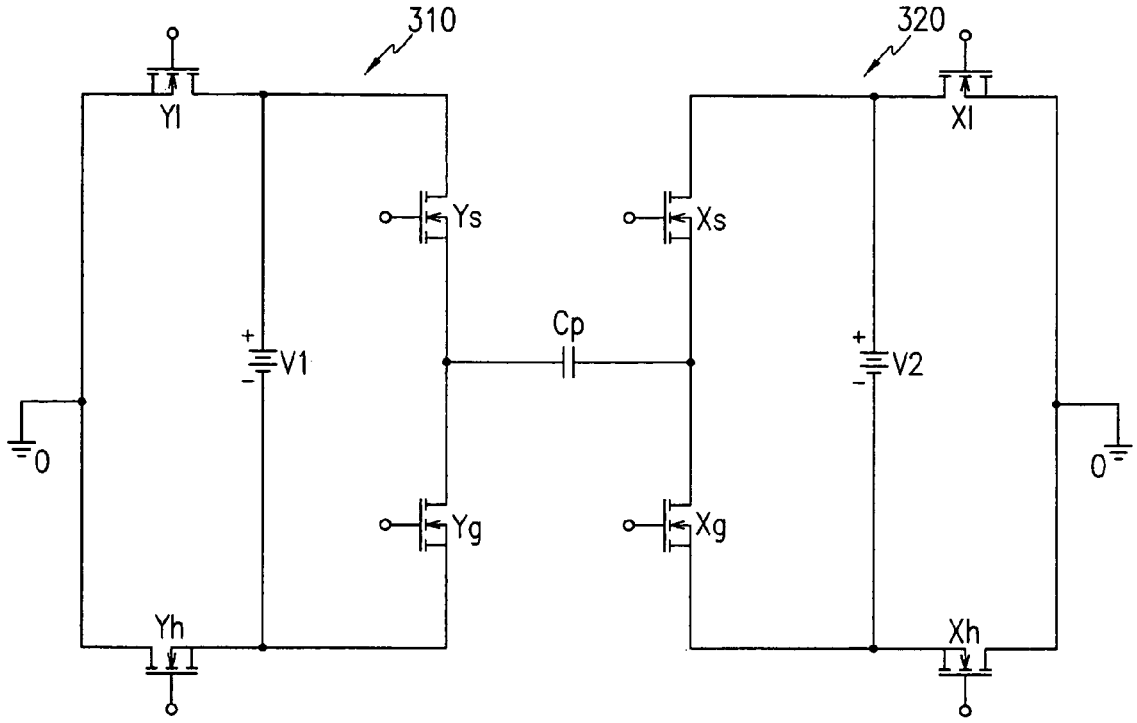
FIG. 2 shows a brief schematic circuit diagram of a PDP driver circuit according to a first exemplary embodiment of the present invention.
Figure 3:
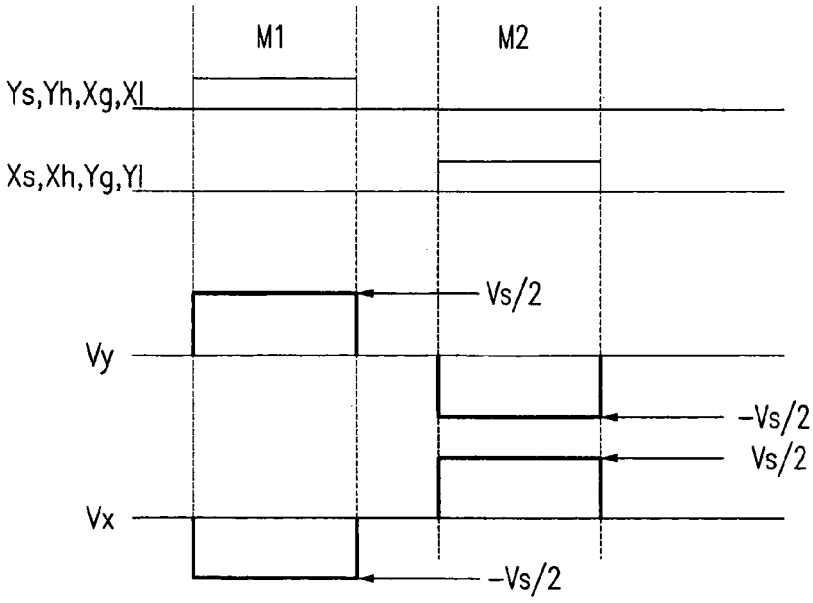
FIG. 3 shows an operation timing diagram of for the driver circuit of FIG. 2.
Figure 4A:
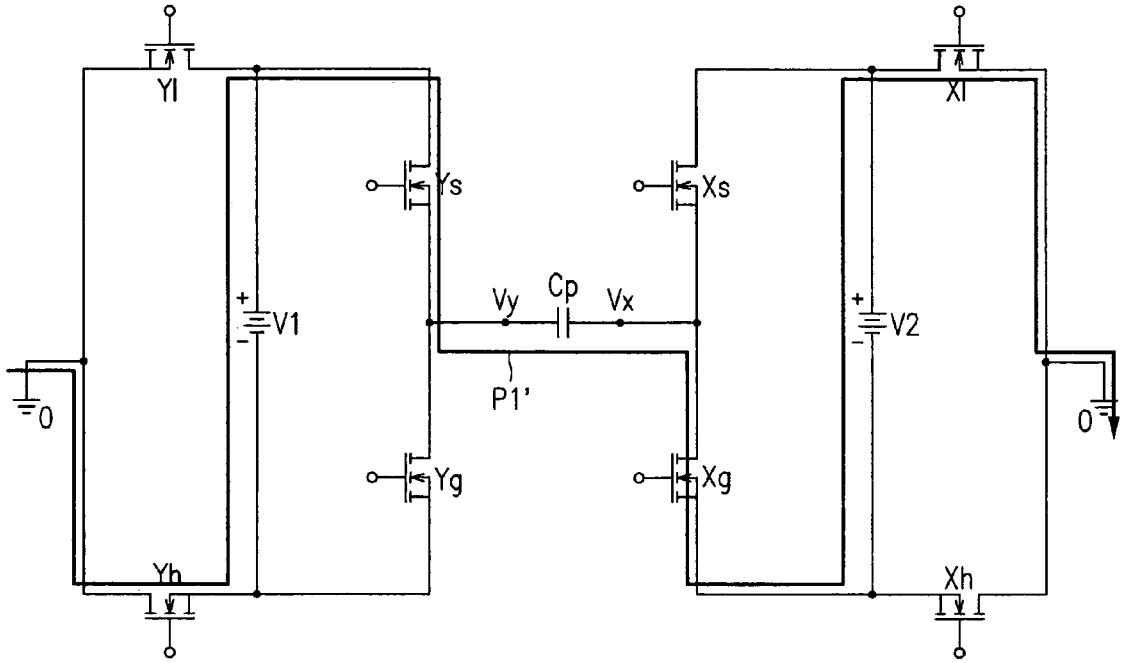
FIGS. 4A and 4B show schematic circuit diagrams showing the current paths of the respective modes in the PDP driver circuit of FIG. 2.
Figure 4B:
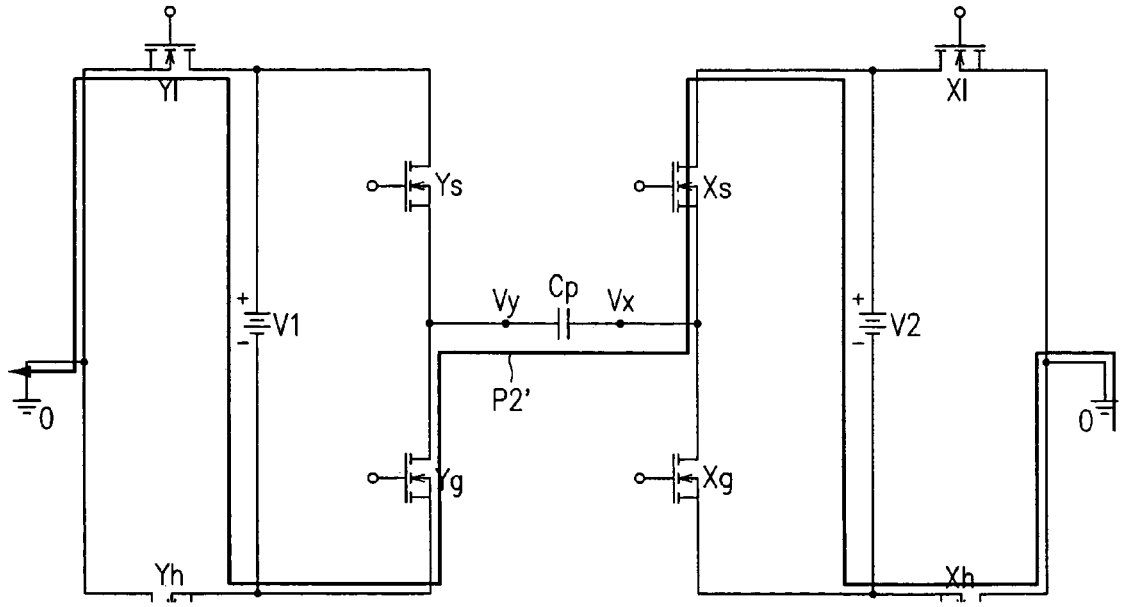

FIG. 2 is a brief schematic circuit diagram of a PDP driver circuit according to the first exemplary embodiment of the present invention. FIG. 3 is an operation timing diagram of the PDP driver circuit of FIG. 2, and FIGS. 4A and 4B are schematic circuit diagrams showing the current paths of the respective modes in the PDP driver circuit of FIG. 2.

The PDP driver circuit of FIG. 2 includes a Y electrode driver 310, and an X electrode driver 320. The Y electrode driver 310 is coupled to the Y electrode of a panel capacitor Cp, and includes four switches Ys, Yg, Yl, and Yh, and a floating voltage source V1 having a voltage of Vs/2. The voltage of Vs/2 is half of the sustain voltage Vs needed for sustaining the panel. The X electrode driver 320 is coupled to the X electrode of the panel capacitor Cp, and includes four switches Xs, Xg, Xl, and Xh, and a floating voltage source V2 having a voltage of Vs/2.

The switches Ys and Yl are coupled in series between the Y electrode of the panel capacitor Cp and the ground terminal 0, and the switches Yg and Yh are coupled in series between the Y electrode of the panel capacitor Cp and the ground terminal 0. The floating voltage source V1 is coupled between a node between the switches Ys and Yl and a node between the switches Yg and Yh. A higher potential side of the floating voltage source V1 is coupled to the node between the switches Ys and Yl.

The switches Xs and Xl are coupled in series between the X electrode of the panel capacitor Cp and the ground terminal 0, and the switches Xg and Xh are coupled in series between the X electrode of the panel capacitor Cp and the ground terminal 0. The floating voltage source V2 is coupled between a node between the switches Xs and Xl and a node between the switches Xg and Xh. A higher potential side of the floating voltage source V2 is coupled to the node between the switches Xs and Xl.

In FIG. 2, the switches Ys, Yh, Yl, Yg, Xs, Xh, Xl, and Xg are illustrated as MOSFETs. However, the switches are not limited to MOSFETs. For example, other suitable switches that have similar characteristics and/or can perform same or similar functions may be used instead. Any such switches that are used instead of MOSFETs should have a body diode.

Referring to FIGS. 3, 4A, and 4B, a driving method for the PDP driving circuit of FIG. 2 will be described.

First, in the mode 1 (M1) as shown in FIG. 3, the switches Ys, Yh, Xg, and Xl are turned on while the switches Xs, Xh, Yg, and Yl are turned off.

As shown in FIG. 4A, the voltages of Vs/2 and −Vs/2 are applied to the Y and X electrodes for the panel capacitor Cp according to an illustrated path P1' in order of the ground terminal 0, the switch Yh, the floating voltage source V1, the switch Ys, the panel capacitor Cp, the switch Xg, the floating voltage source V2, the switch Xl, and the ground terminal 0. Therefore, Y and X electrode voltages Vy and Vx at the panel capacitor Cp are respectively Vs/2 and −Vs/2, and the sustain voltage Vs is applied to the panel capacitor Cp.

In this instance, since the floating voltage source V1 is coupled to the turned-off switches Yl and Yg, the voltages at the switches Yl and Yg are respectively clamped to Vs/2. And since the floating voltage source V2 is coupled to the turned-off switches Xs and Xh, the voltages at the switches Xs and Xh are respectively clamped to Vs/2.

In the mode 2 (M2), as shown in FIG. 3, the switches Ys, Yh, Xg, and Xl are turned off and the switches Xs, Xh, Yg, and Yl are turned on.

As shown in FIG. 4B, the voltages of −Vs/2 and Vs/2 are applied to the Y and X electrodes for the panel capacitor Cp according to an illustrated path P2' in order of the ground terminal 0, the switch Xh, the floating voltage source V2, the switch Xs, the panel capacitor Cp, the switch Yg, the power V1, the switch Yl, and the ground terminal 0. Therefore, Y and X electrode voltages Vy and Vx at the panel capacitor Cp are respectively −Vs/2 and Vs/2, and the sustain voltage Vs is applied to the panel capacitor Cp.

In this instance, in the same manner as the mode 1 (M1), since the floating voltage source V1 is coupled to the turned-off switches Ys, and Yh, the voltages at the switches Ys and Yh are clamped to Vs/2, and since the floating voltage source V2 is coupled to the turned-off switches Xl and Xg, the voltages at the switches Xl and Xg are clamped to Vs/2.

According to the first exemplary embodiment of the present invention, the voltages at the switches Ys, Yh, Xl, and Xg and the switches Yl, Yg, Xs, and Xh can be clamped to Vs/2 through the floating voltage sources V1 and V2 while the sustain voltage Vs is applied to the panel capacitor Cp. Thus, switches having a low withstand voltage can be used as the switches Ys, Yh, Yl, Yg, Xs, Xh, Xl, and Xg. In addition, there is no need for using a capacitor to apply a negative voltage −Vs/2 to the Y or X electrode of the panel capacitor Cp, so that a high in-rush current does not occur during the initial startup.

To apply a waveform for sustaining to the panel capacitor Cp, a reactive power is necessary as well as the power for a discharge because of the capacitance component of the panel capacitor Cp. Next, a detailed description will be given for an exemplary embodiment having a power recovery circuit in addition to the PDP driver circuit of FIG. 2, with references to FIGS. 5, 6, and 7A to 7H.

Figure 5:
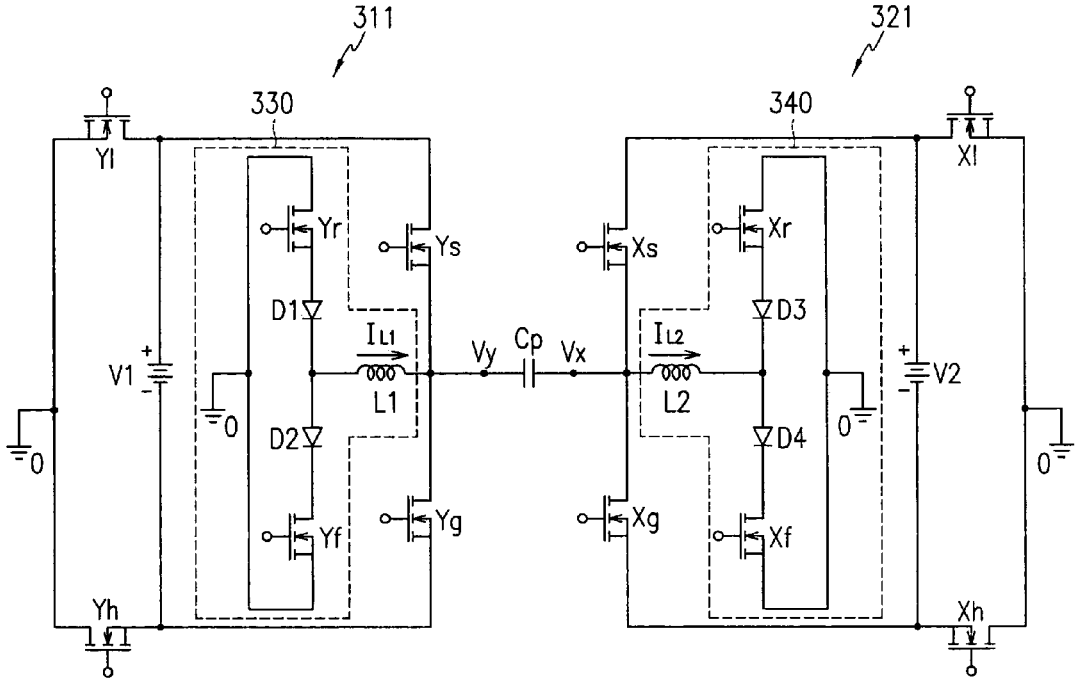
FIG. 5 shows a brief schematic circuit diagram of a PDP driver circuit according to a second exemplary embodiment of the present invention.
Figure 6:
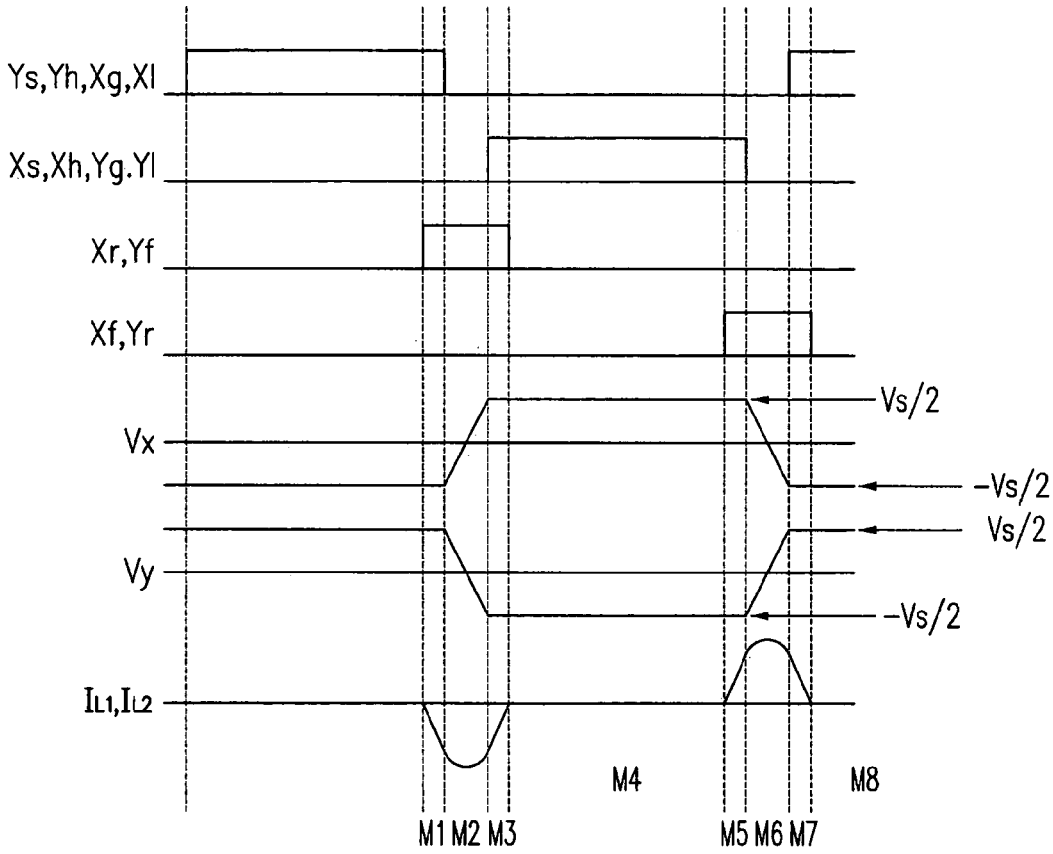
FIG. 6 shows an operation timing diagram of the PDP driver circuit of FIG. 5.

FIG. 5 is a schematic circuit diagram of a PDP driver circuit according to a second exemplary embodiment of the present invention. FIG. 6 is a timing diagram for the PDP driver circuit of FIG. 5, and FIGS. 7A to 7H are schematic circuit diagrams that show the current paths of the respective modes in the PDP driver circuit of FIG. 5.

The PDP driver circuit of FIG. 5 includes Y and X power recovery sections 330 and 340 in addition to the PDP driver circuit of FIG. 2. In other words, the PDP driver circuit of FIG. 5 includes an Y electrode driver 311, which includes the Y electrode driver 310 of FIG. 2 and the Y power recovery section 330, and an X electrode driver 321, which includes the X electrode driver 320 of FIG. 2 and the X power recovery section 340.

The Y electrode power recovery section 330 includes an inductor L1 and switches Yr and Yf. The inductor L1 is coupled to a node between the switches Ys and Yg, i.e., the Y electrode of the panel capacitor Cp. The switches Yr and Yf are coupled in parallel between the inductor L1 and the ground terminal 0. The Y electrode power recovery section 330 also includes diodes D1 and D2 coupled between the switches Yr and Yf and the inductor L1, respectively. The diodes D1 and D2 serve to interrupt a current path that may be formed by the body diodes of the switches Yr and Yf.

The X electrode power recovery section 340 includes an inductor L2 and switches Xr and Xf, and additionally diodes D3 and D4. The structure of the X electrode power recovery section 340 is substantially the same as that of the Y electrode power recovery section 330 and will not be described further. The switches Yr, Yf, Xr, and Xf of the Y and X electrode power recovery sections 330 and 340 are MOSFETs having a body diode. In other embodiments, other suitable switches may be used instead of MOSFETs.

Next, the sequential operation of the driver circuit according to the second exemplary embodiment of the present invention will be described with references to FIGS. 6 and 7A to 7H. Here, the operation proceeds in the order of eight modes M1 to M8, which are changed by the operation of switches. The phenomenon referred to as "LC resonance" herein is not a continuous oscillation but a voltage or current variation caused by the combination of the inductors L1 and L2 and the panel capacitor Cp as the switches Xr, Yf, Xf, and Yr are operated.

It is assumed in the second exemplary embodiment of the present invention that the switches Ys, Yh, Xg, and Xl are turned on before the start of the mode 1 (M1), so the Y and X electrode voltages Vy and Vx of the panel capacitor Cp are sustained at Vs/2 and −Vs/2, respectively. The inductances of the inductors L1 and L2 are both denoted by L.

Figure 7A:
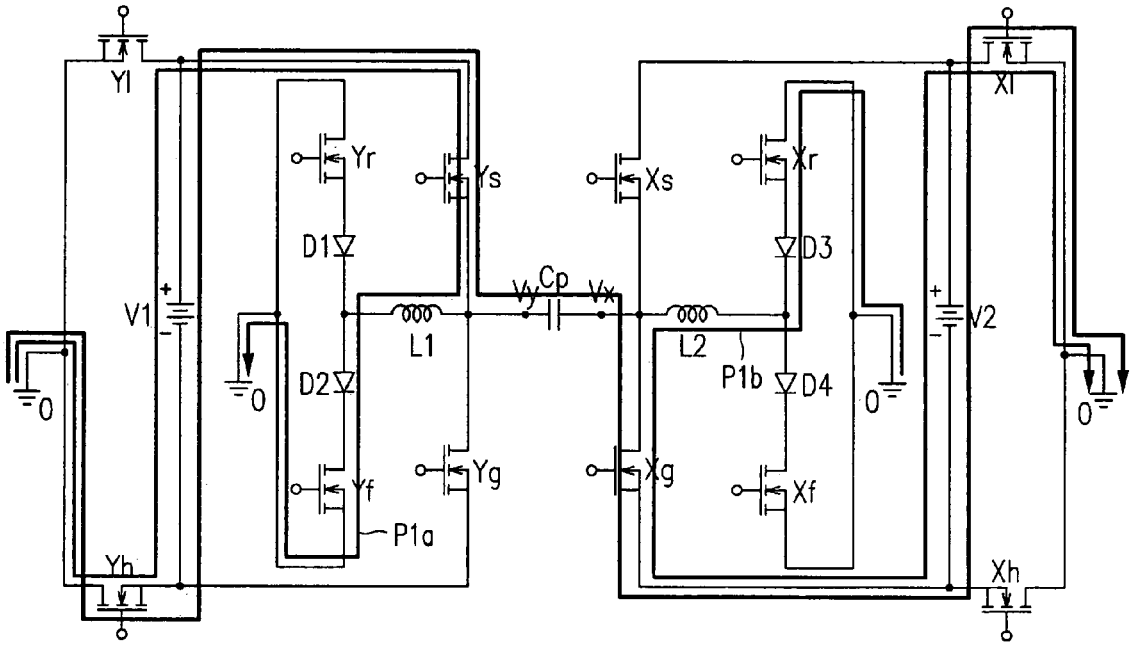
FIGS. 7A–7H show schematic circuit diagrams showing the current paths of the respective modes in the PDP driver circuit of FIG. 5.

In the mode 1 (M1), as illustrated in FIGS. 6 and 7A, the Y and X electrode voltages Vy and Vx of the panel capacitor Cp are sustained at Vs/2 and −Vs/2 by the turned-on switches Ys and Yh and the switches Xl and Xg, respectively. In the same manner as described in the mode 1 (M1) of the first exemplary embodiment, the voltages of the switches Yl, Yg, Xs, and Xh are all clamped to Vs/2 by the floating voltage sources V1 and V2, respectively. As illustrated in FIG. 7A, when the switches Yf and Xr are turned on, there are formed a current path P1*a*, which includes the ground terminal 0, the switch Yh, the floating voltage source V1, the switch Ys, the inductor L1, the switch Yf, and the ground terminal 0, and a current path P1*b* including the ground terminal 0, the switch Xr, the inductor L2, the switch Xg, the floating voltage source V2, the switch Xl, and the ground terminal 0 in sequence. A voltage difference caused by the two current paths causes a current to be injected to the inductors L1 and L2, so the currents IL1 and IL2 flowing to the inductors L1 and L2, respectively, are both linearly increased with a slope of Vs/2L.

Figure 7B:
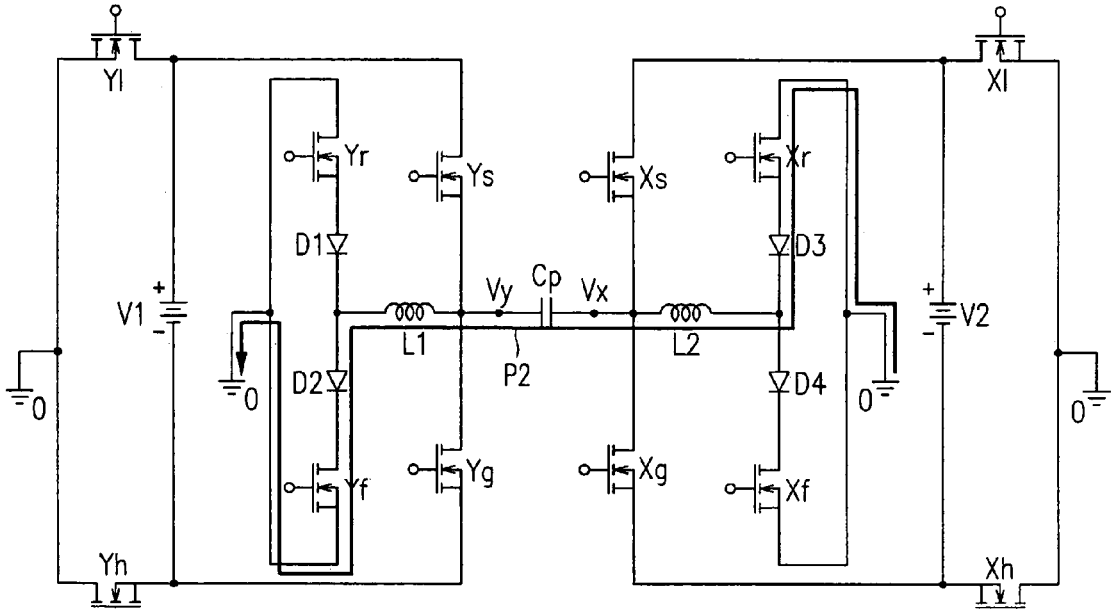

In the mode 2 (M2), as shown in FIG. 7B, the switches Ys, Yh, Xg, and Xl are turned off to form a current path P2 that includes the switch Xr, the inductor L2, the panel capacitor Cp, the inductor L1, and the switch Yf in sequence, causing an LC resonance current by the inductors L1 and L2, and the panel capacitor Cp. Due to the resonance current, the Y electrode voltage Vy of the panel capacitor Cp falls and the X electrode voltage Vx rises. These voltages Vy and Vx do not exceed −Vs/2 and Vs/2 due to the body diodes of the switches Yl and Yg, and Xs and Xh, respectively.

In this manner of the mode 2 (M2), the LC resonance occurs while currents flow to the inductors L1 and L2, thereby changing the Y and X electrode voltages Vy and Vx to −Vs/2 and Vs/2, respectively, and increasing the conversion rate even with a parasitic component in the circuit.

Figure 7C:
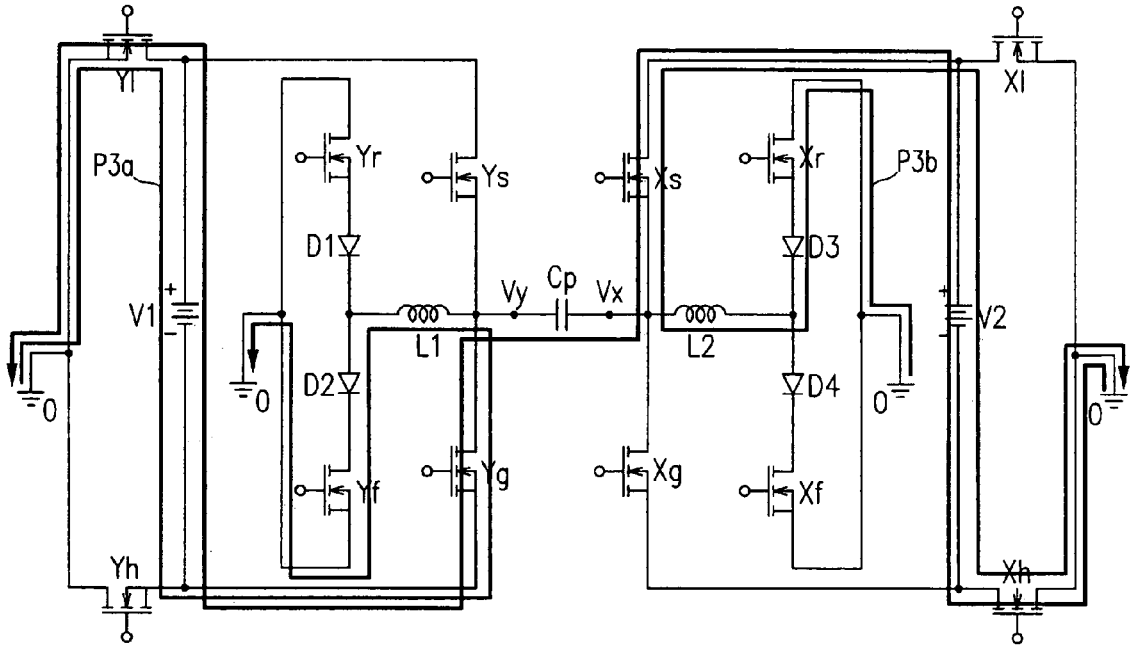

In the mode 3 (M3), the switches Xs, Xh, Yg, and Yl are turned on, so the Y and X electrode voltages Vy and Vx of the panel capacitor Cp are sustained at −Vs/2 and Vs/2, respectively, as illustrated in FIG. 7C. The current IL1 flowing to the inductor L1 is recovered through a path P3*a* including the body diode of the switch Yl, the floating voltage source V1, the body diode of the switch Yg, the inductor L1, and the switch Yf in sequence. The current IL2 flowing to the inductor L2 is recovered through a path P3*b* including the switch Xr, the inductor L2, the body diode of the switch Xs, the floating voltage source V2, and the body diode of the switch Xh in sequence.

Figure 7D:
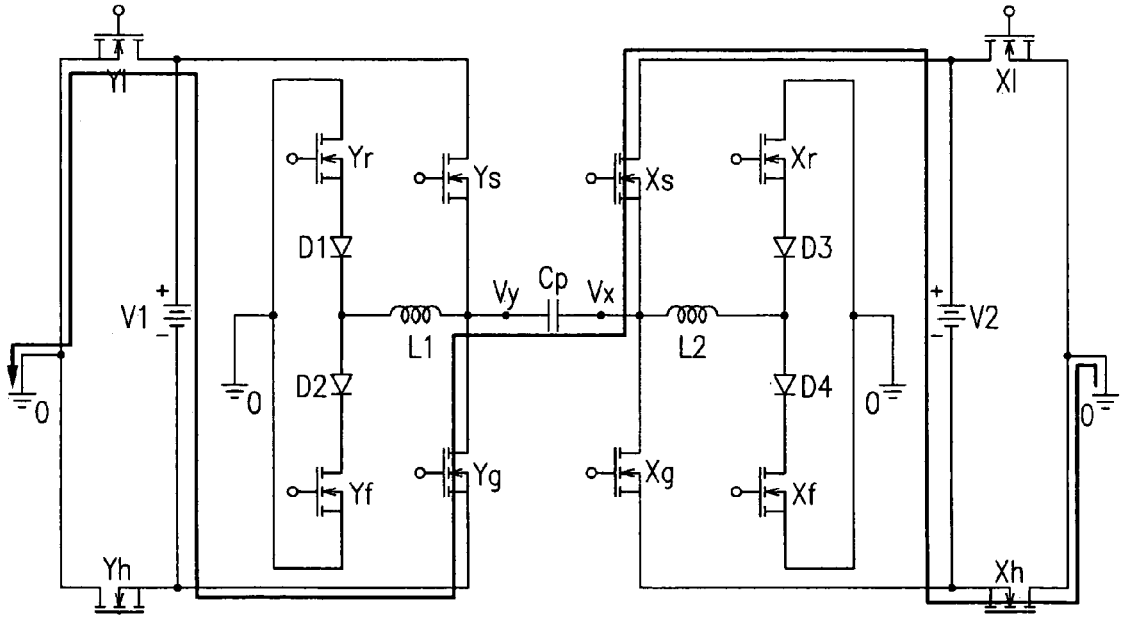

In the mode 4 (M4), the switches Yf and Xr are turned off when the currents IL1 and IL2 flowing to the inductors L1 and L2 reach 0A. With the turned-on switches Yl, Yg, Xs, and Xh, the Y and X electrode voltages Vy and Vx of the panel capacitor Cp are sustained at −Vs/2 and Vs/2, respectively, as shown in FIG. 7D.

Figure 7E:
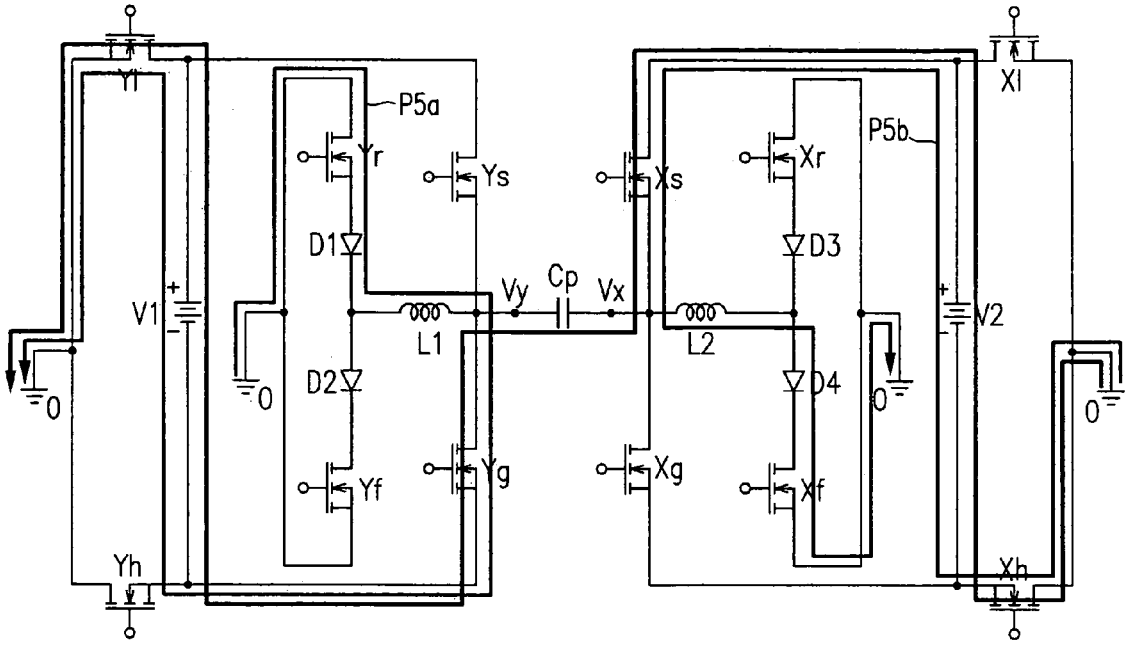
Figure 7F:
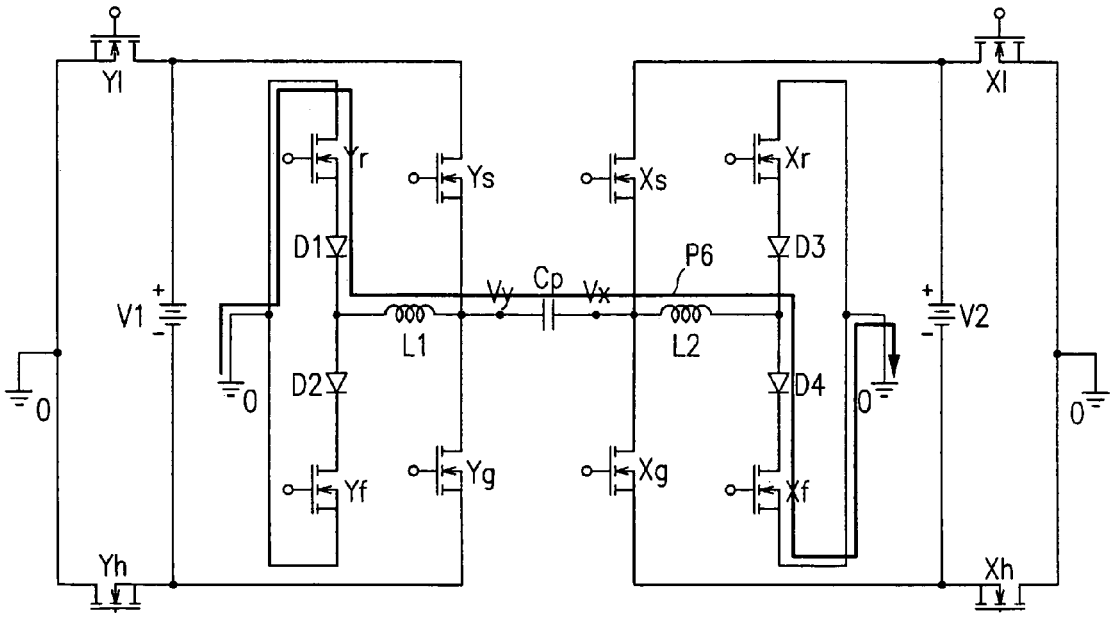

In the mode 5 (M5), currents are injected to the inductors L1 and L2 while the Y and X electrode voltages Vy and Vx of the panel capacitor Cp are sustained at −Vs/2 and Vs/2, respectively. More specifically, as illustrated in FIG. 7E, the switches Yr and Xf are turned on to form a path P5*a* including the ground terminal 0, the switch Yr, the inductor L1, the switch Yg, the floating voltage source V1, the switch Yl, and the ground terminal 0 in sequence, and a path P5*b* including the ground terminal 0, the switch Xh, the floating voltage source V2, the switch Xs, the inductor L2, the switch Xf, and the ground terminal 0 in sequence. Due to the voltage difference formed by two paths, the currents IL1 and IL2 flowing to the inductors L1 and L2, respectively, are both linearly increased with a slope of Vs/2L.

In the modes 3, 4, and 5 (M3, M4, and M5), the switches Ys, Yh, Xl, and Xg are turned off while the Y and X electrode voltages Vy and Vx of the panel capacitor Cp are sustained at −Vs/2 and Vs/2, respectively. So, the voltages of the switches Ys, Yh, Xl, and Xg are all clamped to Vs/2 by the floating voltage sources V1 and V2, respectively, as described in the mode 2 of the first exemplary embodiment.

After injecting the current to the inductors L1 and L2 in the mode 5 (M5), the switches Xs, Xh, Yl, and Yg are turned off in the mode 6 (M6). Then, an LC resonance occurs between the inductors L1 and L2 and the panel capacitor Cp through a current path P6 shown in FIG. 7F. Due to the resonance current, the Y electrode voltage Vy of the panel capacitor Cp rises and the X electrode voltage Vx falls. These voltages Vy and Vx do not exceed Vs/2 and −Vs/2 due to the body diodes of the switches Ys and Yh, and Xl and Xg, respectively. As in the mode 2 (M2), the resonance occurs while the currents flow to the inductors L1 and L2 in the mode 6 (M6).

Figure 7G:
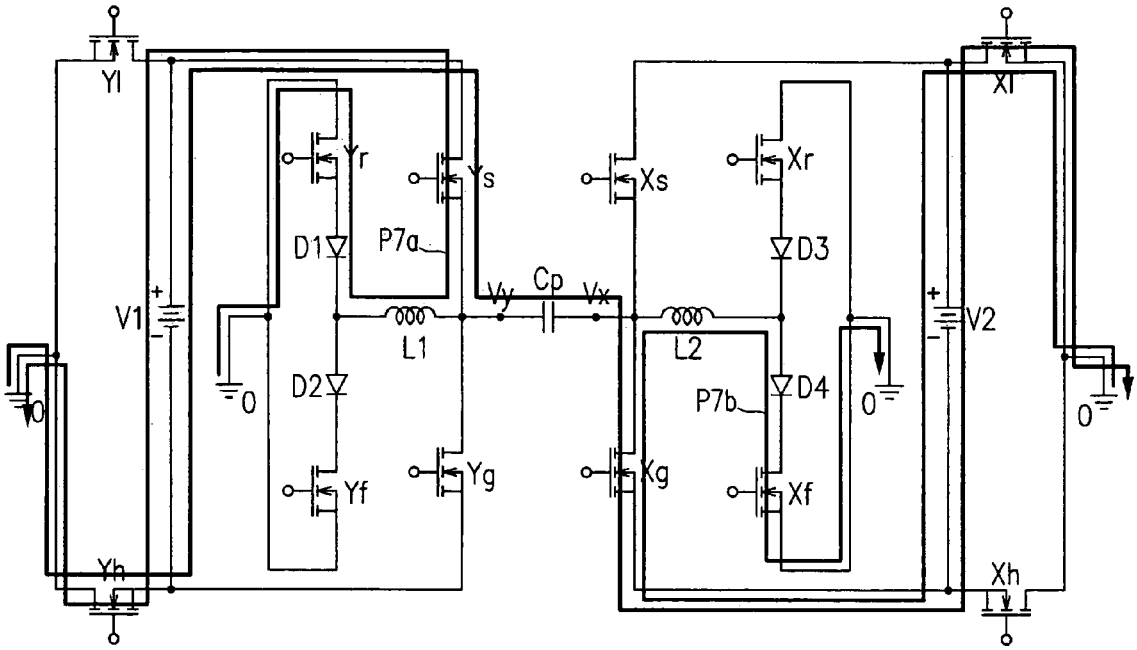

In the mode 7 (M7), the switches Ys, Yh, Xl, and Xg are turned on, so the Y and X electrode voltages Vy and Vx of the panel capacitor Cp are sustained at Vs/2 and −Vs/2, respectively, through the path of FIG. 7G. The current IL1 flowing to the inductor L1 is recovered through a path P7*a* including the switch Yr, the inductor L1, the body diode of the switch Ys, the floating voltages source V1, and the body diode of the switch Yh in sequence. The current IL2 flowing to the inductor L2 is recovered through a path P7*b* including the body diode of the switch Xl, the floating voltage source V2, the body diode of the switch Xg, the inductor L2, and the switch Xf in sequence.

Figure 7H:
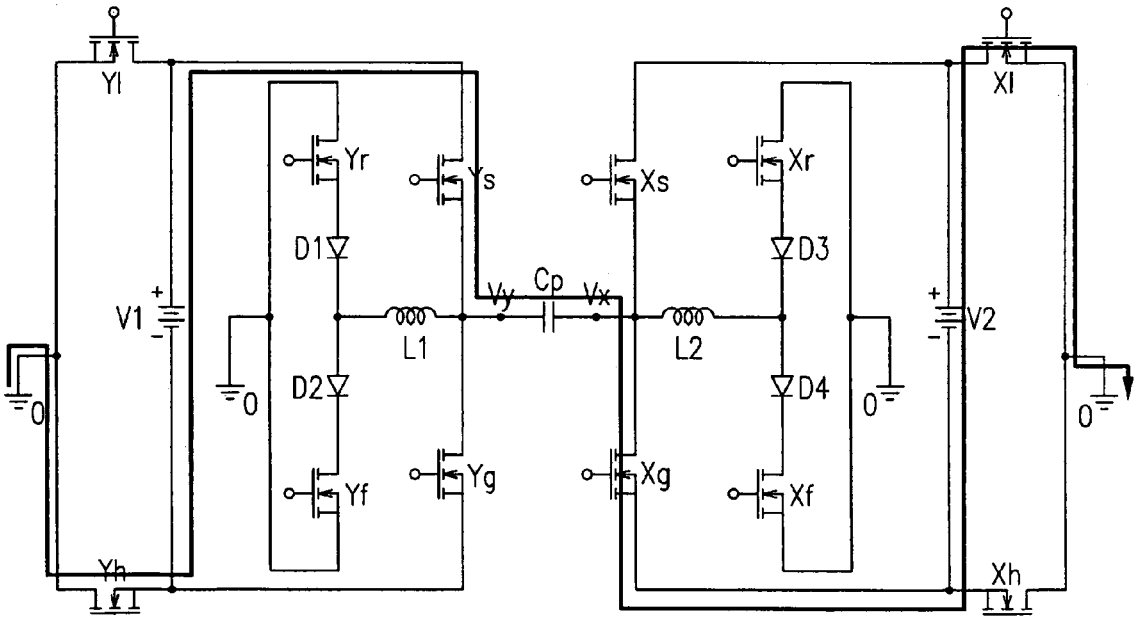

In the mode 8 (M8), the switches Yr and Xf are turned off when the currents IL1 and IL2 flowing to the inductors L1 and L2 reach 0A. With the turned-on switches Ys, Yh, Xl, and Xg, the Y and X electrode voltages Vy and Vx of the panel capacitor Cp are sustained at Vs/2 and −Vs/2, respectively, as shown in FIG. 7H. In the modes 7 and 8 (M7 and M8), the voltages at the switches Yl, Yg, Xs, and Xh are all clamped to Vs/2 by the floating voltage sources V1 and V2, respectively, in the same manner as described in reference to the mode 1 (M1).

Subsequently, the cycle of modes 1 to 8 repeats to generate the Y and X electrode voltages Vy and Vx swinging between Vs/2 and −Vs/2, so the potential difference between the X and Y electrodes can be the sustain voltage Vs.

In the second exemplary embodiment of the present invention, the resonance is caused after injecting the current to the inductors L1 and L2 through the processes of the modes 1 and 5 (M1 and M5). However, the resonance can occur without the processes of the modes 1 and 5 (M1 and M5). In addition, another type of power recovery circuit can be used instead of the above-stated power recovery circuit.

The ground terminal 0 supplies the voltage of 0 volts in FIG. 2, and a voltage source V3 for supplying the voltage of (Vs−2Vh)/2 can be used instead of the ground terminal 0. Accordingly, the voltage of Vh is supplied to the X electrode of the panel capacitor Cp according to the voltage difference between the voltage sources V1 and V3, and the voltage of (Vh−Vs) is supplied to the Y electrode according to the voltage difference between the inverse-coupled voltage source V2 and the voltage source V3, as shown in FIG. 4A. In the same manner as shown in FIG. 4B, the voltage of (Vh−Vs) is supplied to the X electrode of the panel capacitor Cp, and the voltage of Vh is supplied to the Y electrode thereof, thereby maintaining the voltage difference at the panel capacitor Cp at Vs and generating the sustain. In particular, when the voltage supplied by the voltage source V3 is set to be Vs/2, the Y and X electrode voltages Vy and Vx of the panel capacitor Cp swing between 0V and Vs.

According to the exemplary embodiments of the present invention, the withstand voltage of each switch can be half of the voltage Vs necessary for the sustain, so switches of a low withstand voltage can be used to reduce the production cost. This also prevents an in-rush current that may occur when the terminal voltages of the panel capacitor are changed by using a voltage stored in an external capacitor. Furthermore, the driver circuit in exemplary embodiments of the present invention can be adapted irrespective of the waveform of the sustain voltage pulse, by changing the power source applied to the driver circuit.

While this invention has been described in connection with certain exemplary embodiments, it is to be understood that the invention is not limited to the disclosed exemplary embodiments, but, on the contrary, is intended to cover various modifications and/or equivalent arrangements included within the spirit and scope of the appended claims.

What is claimed is:

1. A plasma display panel (PDP) driver for applying a driving voltage to a panel capacitor formed between first and second electrodes and having first and second ends, the PDP driver comprising:

a first voltage source having a positive polarity terminal and a negative polarity terminal for supplying a first voltage;

a second voltage source for supplying a second voltage;

a first switch coupled between a first end of the panel capacitor and the positive polarity terminal of the first voltage source;

a second switch coupled between the positive polarity terminal of the first voltage source and the second voltage source;

a third switch coupled between the first end of the panel capacitor and a negative polarity terminal of the first voltage source; and a fourth switch coupled between the negative polarity terminal of the first voltage source and the second voltage source, wherein when the first and fourth switches are turned on, a third voltage is applied to the first end of the panel capacitor, the third voltage being a voltage difference between the first and second voltages, when the second and third switches are turned on, a fourth voltage is applied to the first end of the panel capacitor, the fourth voltage being a voltage difference between a negative value of the first voltage and the second voltage, and wherein the first and fourth switches and the second and third switches are alternately turned on to alternately apply the third and fourth voltages, respectively, to the first end of the panel capacitor.

2. The PDP driver of claim 1, wherein a voltage difference between the third and fourth voltages is a sustain voltage for a PDP.

3. The PDP driver of claim 1, further comprising an inductor coupled to the first end of the panel capacitor, wherein the voltage at the first end of the panel capacitor is changed between the third and fourth voltages because of resonance of the inductor and the panel capacitor.

4. The PDP driver of claim 3, further comprising first and second resonance switches that are coupled in parallel between the inductor and the second voltage source.

5. The PDP driver of claim 4, further comprising a first diode coupled between the first resonance switch and the inductor and a second diode coupled between the second resonance switch and the inductor.

6. The PDP driver of claim 1, wherein each of the first, second, third and fourth switches has a body diode.

7. The PDP driver of claim 1, wherein the fourth voltage is applied to the second end of the panel capacitor while the third voltage is applied to the first end of the panel capacitor, and the third voltage is applied to the second end of the panel capacitor while the fourth voltage is applied to the first end of the panel capacitor.

8. The PDP driver of claim 7, further comprising:

a third voltage source having a positive polarity terminal and a negative polarity terminal for supplying a fifth voltage, which is substantially the same as the first voltage.

a fifth switch coupled between the second end of the panel capacitor and the positive polarity terminal of the third voltage source;

a sixth switch coupled between the positive polarity terminal of the third voltage source and the second voltage source;

a seventh switch coupled between the second end of the panel capacitor and the negative polarity terminal of the third voltage source; and an eighth switch coupled between the negative polarity terminal of the third voltage source and the second voltage source.

9. A plasma display panel (PDP) driver for applying a driving voltage to a panel capacitor formed between first and second electrodes and having first and second ends, the PDP driver comprising:

a first voltage source having a positive polarity terminal and a negative polarity terminal for supplying a first voltage;

a second voltage source for supplying a second voltage;

a first switch coupled between the first end of the panel capacitor and the positive polarity terminal of the first voltage source; and a second switch coupled between the first end of the panel capacitor and the negative polarity terminal of the first voltage source, wherein a first electrical path is formed between the negative polarity terminal of the first voltage source and the second voltage source so as to apply a third voltage to the first end of the panel capacitor when the first switch is turned on, the third voltage being a difference between the first and second voltages;

wherein a second electrical path is formed between the positive polarity terminal of the first voltage source and the second voltage source so as to apply a fourth voltage to the first end of the panel capacitor when the second switch is turned on, the fourth voltage being a difference between a negative value of the first voltage and the second voltage, and wherein the first and second switches are alternately turned on.

10. The PDP driver of claim 9, further comprising:

a third switch coupled between the negative polarity terminal of the first voltage source and the second voltage source so as to form the first electrical path; and a fourth switch coupled between the positive polarity terminal of the first voltage source and the second voltage source so as to form the second electrical path.

11. The PDP driver of claim 9, wherein the fourth voltage is applied to the second end of the panel capacitor while the third voltage is applied to the first end of the panel capacitor, and the third voltage is applied to the second end of the panel capacitor while the fourth voltage is applied to the first end of the panel capacitor.

12. The PDP driver of claim 11, wherein a voltage difference between the third and fourth voltages is a sustain voltage for a PDP.

13. The PDP driver of claim 12, wherein the first voltage is one half of the sustain voltage, and the second voltage is a ground voltage.

14. The PDP driver of claim 11, further comprising:

a third voltage source having a positive polarity terminal and a negative polarity terminal for supplying a fifth voltage, which is substantially the same as the first voltage;

a third switch coupled between the second end of the panel capacitor and the positive polarity terminal of the third voltage source; and a fourth switch coupled between the second end of the panel capacitor and the negative polarity terminal of the third voltage source, wherein a third electrical path is formed between the positive polarity terminal of the third voltage source and the second voltage source so as to apply the third voltage to the second end of the panel capacitor when the third switch is turned on;

wherein a fourth electrical path is formed between the negative polarity terminal of the third voltage source and the second voltage source so as to apply the fourth voltage to the second end when the fourth switch is turned on, and wherein the third and fourth switches are alternately turned on.

15. The PDP driver of claim 9, further comprising a power recovery section coupled to the first end of the panel capacitor, the power recovery section including an inductor, and being adapted for using resonance generated between the inductor and the panel capacitor to change the voltage at the first end of the panel capacitor.

16. The PDP driver of claim 15, wherein the power recovery section uses a voltage difference between the first and second voltage sources to inject current to the inductor, and generates the resonance while the current flows to the inductor.

17. A method for driving a plasma display panel (PDP) by alternately applying first and second voltages to a panel capacitor formed between first and second electrodes, comprising:

coupling a positive polarity terminal of a floating voltage source for supplying a third voltage to a first end of the panel capacitor;

coupling a negative polarity terminal of the floating voltage source to a first voltage source for supplying a fourth voltage;

coupling the negative polarity terminal of the floating voltage source to the first end of the panel capacitor; and coupling the positive polarity terminal of the floating voltage source to the first voltage source, wherein a voltage difference between the third and fourth voltages corresponds to the first voltage, and a voltage difference between a negative value of the third voltage and the fourth voltage corresponds to the second voltage.

18. The method of claim 17, wherein coupling a positive polarity terminal further comprises applying the second voltage to the second end of the panel capacitor, and coupling a negative polarity terminal further comprises applying the first voltage to the second end of the panel capacitor.

19. The method of claim 18, wherein a voltage difference between the first and second voltages is a sustain voltage for a PDP.

20. The method of claim 17, further comprising using resonance of an inductor coupled to the first end of the panel capacitor to change the voltage at the first end, before applying the second voltage to the first end of the panel capacitor.

* * * * *